US006426731B2

(12) United States Patent
Hirtzlin et al.

(10) Patent No.: US 6,426,731 B2
(45) Date of Patent: Jul. 30, 2002

(54) DEVICE FOR EMITTING AND/OR RECEIVING ELECTROMAGNETIC WAVES COMPRISING A LENS MADE OF A SHAPED VOLUME OF DIELECTRIC MATERIAL

(75) Inventors: Patrice Hirtzlin; Ali Louzir; Jean-François Pintos; Franck Thudor, all of Rennes (FR)

(73) Assignee: Thomson Licensing, SA, Boulogne-Billancourt (FR)

( * ) Notice: Subject to any disclaimer, the term of this patent is extended or adjusted under 35 U.S.C. 154(b) by 0 days.

(21) Appl. No.: 09/768,972

(22) Filed: Jan. 24, 2001

(51) Int. Cl.[7] ..... H01Q 15/08
(52) U.S. Cl. ..... 343/911 R; 264/44
(58) Field of Search ..... 343/910, 911 R, 343/911 L; 264/44, 42, 43; 428/325, 402; H01Q 15/08

(56) References Cited

U.S. PATENT DOCUMENTS

| | | | | |
|---|---|---|---|---|
| 3,886,234 A | * | 5/1975 | Gates et al. | 343/911 R |
| 3,917,773 A | | 11/1975 | Gates et al. | 264/44 |
| 5,154,973 A | | 10/1992 | Imagawa et al. | 428/325 |

FOREIGN PATENT DOCUMENTS

| | | | |
|---|---|---|---|
| EP | 0 632 522 A1 | 1/1995 | H01Q/1/42 |
| FR | 2 786 928 | 6/2000 | H01Q/15/00 |

* cited by examiner

*Primary Examiner*—Tho Phan
(74) *Attorney, Agent, or Firm*—Joseph S. Tripoli; Joseph J. Laks; Frederick A. Wein

(57) ABSTRACT

The invention relates to a device for emitting and/or receiving electromagnetic waves comprising a lens bringing a plurality of directions defined by the radiation space of the lens into correspondence with a plurality of focusing points defining a focusing surface of the lens, the lens comprising a shaped volume of dielectric material. According to the invention, the dielectric material comprises a granular agglomerate defined by a homogeneous or quasi-homogeneous distribution of granules of the same type and of small size with respect to the wavelength ($\lambda_R$, $\lambda_T$) of the electromagnetic waves to be received and/or emitted by the said device, the said granules being held under pressure in the said volume by holding means shaped according to the said volume. The invention also relates to a communications terminal comprising a device according to the invention. Particular application to devices for emitting and/or receiving signals in a telecommunications system with geostationary satellites, moving satellites or earth stations.

11 Claims, 1 Drawing Sheet

DEVICE FOR EMITTING AND/OR RECEIVING ELECTROMAGNETIC WAVES COMPRISING A LENS MADE OF A SHAPED VOLUME OF DIELECTRIC MATERIAL

FIELD OF THE INVENTION

The invention relates to the field of telecommunications. It relates more particularly to a device for emitting and/or receiving electromagnetic waves comprising a lens bringing a plurality of directions defined by the radiation space of the lens into correspondence with a plurality of focusing points defining a focusing surface of the lens, the lens comprising a shaped volume of dielectric material. The invention also relates to a telecommunications terminal.

BACKGROUND OF THE INVENTION

It is known practice, from French patent applications 98/05111 and 98/05112 filed on Apr. 23, 1998 in the name of the Applicant, to use a lens of the Luneberg type in satellite receiving devices, especially for tracking moving satellites.

In theory, the lens must consist of a given number of dielectric layers which is high enough to approach the ideal model of a refractive index varying as a function of the radius, which is characteristic of a Luneberg lens. The refractive index n of a layer and its corresponding dielectric constant $\epsilon$ (or relative permittivity) are thus linked by the equation: $n=\epsilon^{1/2}$. However, the increase in the number of layers is limited in practice by severe tolerances which are incompatible with a mass production manufacturing method. For small lenses, typically of a diameter less than 40 cm for transmissions in the Ku band, a solution to this problem is to opt for a lens with a single layer of dielectric material.

In order to reduce the size of the lens while maintaining effective focusing, it is thus necessary to increase the permittivity of the material, the consequence of which is to disadvantageously increase the weight of the lens. A compromise between the focal length of the lens and its weight is therefore necessary. These restrictions of size and weight require the dielectric material to have a well-defined range of permittivity. For example, for a spherical lens of diameter close to 40 cm and of maximum weight approximately equal to 15 kg, the required permittivity is typically between 1.8 and 2.5. On the other hand, the dielectric material chosen must have low dielectric losses (typically a loss angle of less than 0.001 in the Ku band, for example).

It is known from the prior art to use as dielectric material, a mixture comprising expanded polystyrene filled with, for example, high-density particles or ceramic or metallic particles in order to increase the permittivity of the material, changing it to the desired permittivity range. It is also known practice to use, for the same purpose, a mixture of particles of various components (plastic, ceramic or metal, for example) held together by a binder so as to form a composite dielectric material.

However, these types of mixtures do not allow complete homogeneity of the particles to be achieved in the mixture, especially in a large volume, and therefore they do not guarantee homogeneous permittivity in the volume of the lens. Moreover, the mixture obtained is expensive.

The object of the invention is to remedy these drawbacks.

SUMMARY OF THE INVENTION

For this purpose, a subject of the invention is a device for emitting and/or receiving electromagnetic waves comprising a lens bringing a plurality of directions defined by the radiation space of the lens into correspondence with a plurality of focusing points defining a focusing surface of the lens, the lens comprising a shaped volume of dielectric material, characterized in that the dielectric material comprises a granular agglomerate defined by a homogeneous or quasi-homogeneous distribution of granules of the same type and of small size with respect to the wavelength of the electromagnetic waves to be received and/or emitted by the said device, the said granules being held under pressure in the said volume by holding means shaped according to the said volume.

Thus, the device according to the invention may be produced at low cost according to a manufacturing method which is compatible with mass production. Since the granules are uniformly distributed in the said volume, homogeneous permittivity is ensured throughout the volume.

According to one embodiment, the said holding means are also designed so that the transition of the electromagnetic waves between the radiation space and the said volume is optimally matched. In this way, reflection losses on the surface of the said holding means are minimized.

Advantageously, in order to pass from the radiation space to the volume of granules, the holding means have a permittivity equal to the square root of the permittivity of the composition of the contents of the volume.

According to one embodiment, the holding means have a thickness of a multiple of a quarter wavelength. These holding means thus act as a matching layer.

According to another embodiment, the thickness of the said holding means is either negligible with respect to the wavelength of the electromagnetic waves to be received and/or emitted, or equal to a multiple of the half wavelength of the said waves to be received or emitted, such that the said holding means are electromagnetically transparent with respect to the said waves.

Advantageously, these holding means are made from a material which is solid enough to provide protection against external attack. For example, the holding means comprise a plastic called acrylonitrile-butadiene-styrene (ABS) covering the said volume. These holding means thus act as a radome.

According to one embodiment, the diameter of the granules is less than one tenth of the wavelength of the electromagnetic waves to be received and/or emitted by the said device.

According to one embodiment, the volume consists of a mixture of granules and air which acts as an artificial dielectric material of equivalent permittivity $\epsilon_{equ}$ defined according to the equation:

$$\epsilon_{equ}=((1+2F)\epsilon_{r0}+2(1-F))/((1-F)\epsilon_{r0}+2+F),$$

where F is the ratio of the volume effectively occupied by the granules to the total volume of the said volume (7), and $\epsilon_{r0}$ is the intrinsic permittivity of the granule.

According to one embodiment, the granules are made of a plastic. In this way, the cost price of the device is low.

For example, the granules are made of polystyrene.

In order to increase the permittivity of the dielectric material, each granule is filled with titanium oxide with, for example, a content of 30% by mass.

According to one embodiment, the said holding means comprise a shell a volume of revolution to enable tracking of targets over a solid angle of 360° within the context of satellite tracking, for example. This shell is, for example, spherical, hemispherical or cylindrical.

A subject of the invention is also a telecommunications terminal comprising a device for emitting and/or receiving electromagnetic waves comprising a lens for focusing signals received from one direction at a point, the radiation space of the lens determining a set of directions defining a focusing surface, characterized in that the said emitting and/or receiving device is a device according to the invention.

BRIEF DESCRIPTION OF THE DRAWINGS

Other characteristics and advantages of the present invention will become apparent from the description of exemplary embodiments which follow, taken by way of non-limiting examples, with reference to the appended figures, in which.

DESCRIPTION OF PREFERRED EMBODIMENTS

To simplify the description, the same reference numbers will be used in these figures to denote elements fulfilling the same functions.

Figure 1:
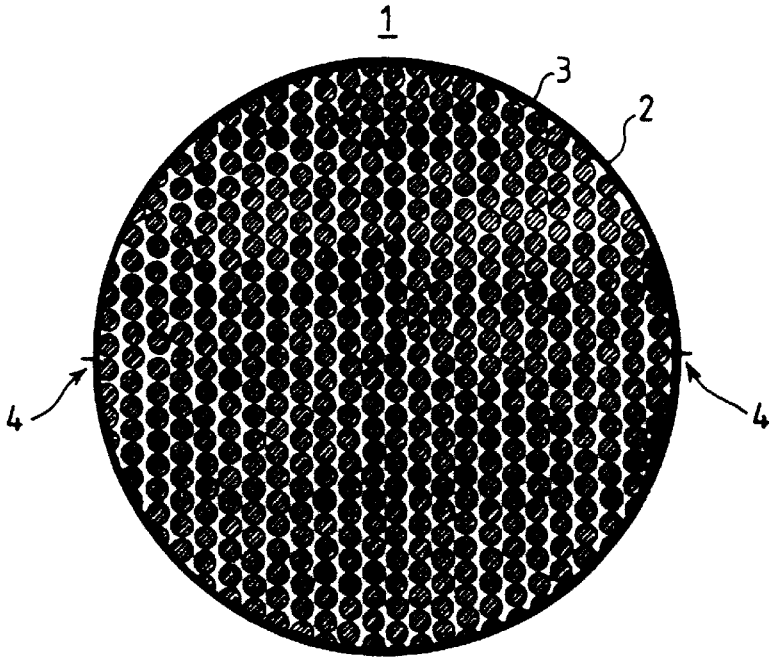
FIG. 1 shows a focusing device according to one embodiment of the invention.

FIG. 1 illustrates a lens 1 comprising a shell 2 filled with plastic granules 3 according to a suitable filling method. The shell is formed from two hemispherical half-shells which are thermoformed or moulded and assembled by bonding or by welding at their free cross sections 4 in order to form a complete sphere. The process of filling the sphere may simply consist in introducing granules 3 through an opening (not shown) made in the upper hemisphere of the shell until the sphere is as full as possible. Once the inner volume of the shell is completely filled with granules 3 so as to exhibit the desired apparent permittivity, the opening is closed again and the lens is ready for use.

Since the granule size is very small with respect to the wavelength, of about one tenth of the wavelength to be received $\lambda_R$ and/or emitted $\lambda_T$, the air/granule mixture is seen electromagnetically as an artificial dielectric material of equivalent permittivity which can be given approximately by the equation:

$$\epsilon_r=[(1+2F)\epsilon_{r0}+2(1-F)]/[(1-F)\epsilon_{r0}+2+F],$$

where $\epsilon_{r0}$ is the intrinsic permittivity of the granule and F the lens fill factor, i.e. the ratio of the volume actually occupied by the granules to the total volume of the lens.

For example, granules made of polystyrene filled with titanium oxide (content of about 30%) placed loose in the spherical volume and having a fill factor of 0.55 give an equivalent permittivity of about 2.

In the embodiment illustrated in FIG. 1, the shell fulfils the function of protecting the lens against any external attack to which it might be subject (protection against bad weather, for example). In order to obtain electromagnetic transparency vis à vis electromagnetic waves, the radome thus formed may be either of a negligible thickness with respect to the wavelength of the waves to be emitted and/or received (thin radome), or of a thickness equal to a multiple of the half wavelength of the said waves (thick radome). For a thin radome, where it has a thickness of about 1 mm in the Ku transmission band, the shell may be made of a solid material of the ABS type.

Figure 2:
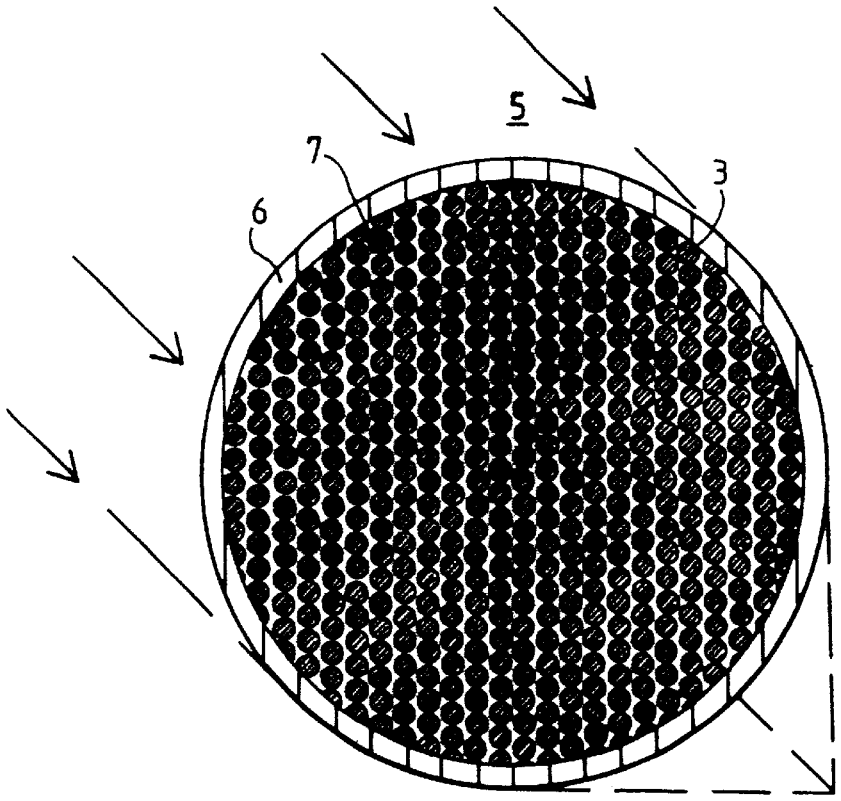
FIG. 2 shows a focusing device according to another embodiment of the invention.

FIG. 2 illustrates a homogeneous lens 5 having a spherical shell 6 acting as matching layer for waves between the radiation space and the volume 7 containing the plastic granules 3. The shell 6 may be made by moulding two half-shells which can be assembled by bonding or by welding. The process for filling the shell 6 may be similar to that for the lens 1 of FIG. 1, i.e. the introduction of granules 3 through an opening in the shell until it is as full as possible.

The shell fulfils the function of matching layer for electromagnetic waves between the air and the air/granule mixture inside the lens. For an air/granule mixture having an apparent permittivity of 2, the shell must have a thickness of 5 mm in order to fulfil the matching function (i.e. a quarter wavelength of the wave to be emitted and/or received) and a permittivity equal to the square root of the apparent permittivity of the lens, i.e. 1.4.

For this purpose, a layer of expanded polystyrene with a high density of about 350 kg/m$^3$, is used.

An experimental trial was carried out on a homogeneous lens 1 with an internal diameter (excluding the shell) of 350 mm and made from particles of polypropylene filled with 30% by mass of titanium oxide $TiO_2$ (hereinafter denoted by PP+ $TiO_2$, for conciseness), the main characteristics of which are shown in the following table:

| | |
|---|---|
| Permittivity of the PP + $TiO_2$ granule ($\epsilon_{r0}$) | 3.2 |
| Apparent permittivity of the PP + $TiO_2$ granules ($\epsilon_r$) | 2.1 |

The simulation of the lens having such characteristics leads to the following characteristics:

- a mass of about 15 kg;
- a focal length f such that f=1.4R (where R is the radius of the lens), i.e. in the present embodiment, a focal length of 245 mm in order to obtain an acceptable phase variation (of about 35° maximum) over the aperture of the antenna;
- a total efficiency of about 60% with a primary source having illumination as a cosine to the power 4.

Note that, in general, the permittivity of the granule 3 may be adjusted according to the content of the filler used (composition with a heavy element, of the titanium oxide type) so that it is possible to reduce or increase the focal length of the device and, consequently, its size.

Thus, by filling shells of defined volumes with granules of defined permittivities and of small size with respect to the wavelength of the radiation, a simple lens is obtained which is inexpensive and suitable for mass production.

This invention is particularly suitable for use in a telecommunications terminal comprising at least one source antenna arranged close to the focus of the lens. This telecommunications terminal is especially exploitable for exchanging signals carrying any type of data (video, fax, Internet, etc.) with geostationary satellites, a system of moving satellites or earth stations.

What is claimed is:

1. Device for emitting and/or receiving electromagnetic waves comprising a lens for focusing signals received from one direction at a point, the radiation space of the lens determining a set of directions defining a focusing surface, the lens comprising a shaped volume of dielectric material comprising a granular agglomerate defined by a homogeneous or quasi-homogeneous distribution of granules of the same type and of small size with respect to the ($\lambda_R$, $\lambda_T$) of the electromagnetic waves to be received and/or emitted by the said device, the said granules being held under pressure in the said volume by holding means shaped according to the said volume, and wherein:

said volume consists of a mixture of granules and air which acts as an artificial dielectric material of equivalent permittivity $\epsilon_{equ}$ defined according to the equation:

$$\epsilon_{equ}+((1+2F)\epsilon_{r0}+2(1-F))/((1-F)\epsilon_{r0}+2+F),$$

where F is the ratio of the volume effectively occupied by the granules to the total volume of the said volume (7), and $\epsilon_{r0}$ is the intrinsic permittivity of the granule.

2. Device according to claim 1, characterized in that the said holding means are also designed so that the transition of the electromagnetic waves between the radiation space and the said volume is optimally matched.

3. Device according to claim 2, characterized in that the holding means have a permittivity equal to the square root of the permittivity of the composition of the contents of the volume.

4. Device according to claim 3, characterized in that the thickness of the said holding means is equal to a multiple of the quarter wavelength of the waves to be received or emitted.

5. Device according to claim 1, characterized in that the thickness of the said holding means is either negligible with respect to the wavelength of the electromagnetic waves to be received and/or emitted, or equal to a multiple of the half wavelength of the said waves to be received or emitted, such that the said holding means are electromagnetically transparent with respect to the said waves.

6. Device according to claim 5, characterized in that these holding means are made from a material which is solid enough to provide protection against external attack.

7. Device according to claim 5, characterized in that the holding means comprise a plastic called acrylonitrile-butadiene-styrene or ABS covering the said volume.

8. Device according to claim 1, characterized in that the diameter of the granules is less than one tenth of the wavelength of the electromagnetic waves to be received and/or emitted by the said device.

9. Device according to claim 1, characterized in that each granule is filled with titanium oxide.

10. Device according to claim 1, characterized in that the said holding means comprise a shell with a volume of revolution, of the spherical, hemispherical or cylindrical type.

11. Telecommunications terminal comprising a device for emitting and/or receiving electromagnetic waves comprising a lens for focusing signals received from one direction at a point, the radiation space of the lens determining a set of directions defining a focusing surface, characterized in that the said emitting and/or receiving device is a device according to claim 1.

* * * * *

UNITED STATES PATENT AND TRADEMARK OFFICE

CERTIFICATE OF CORRECTION

PATENT NO. : 6,426,731 B2
DATED : July 30, 2002
INVENTOR(S) : Patrice Hirtzlin et al.

It is certified that error appears in the above-identified patent and that said Letters Patent is hereby corrected as shown below:

Column 5,
Lines 8-9, "+", first occurrence should be -- = --.

Signed and Sealed this

Eighth Day of March, 2005

JON W. DUDAS
*Director of the United States Patent and Trademark Office*